US010207194B2

(12) United States Patent
Sheltman et al.

(10) Patent No.: US 10,207,194 B2
(45) **Date of Patent: *Feb. 19, 2019**

(54) TRANSFORMABLE TOY AND LAUNCHER

(71) Applicant: Mattel, Inc., El Segundo, CA (US)

(72) Inventors: David Alan Sheltman, Palos Verdes, CA (US); Kevin Kai Cao, Reseda, CA (US); Gustavo Ricardo Ferreyra, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/443,871

(22) Filed: Feb. 27, 2017

(65) Prior Publication Data

US 2017/0165586 A1 Jun. 15, 2017

Related U.S. Application Data

(63) Continuation of application No. 13/907,261, filed on May 31, 2013, now Pat. No. 9,579,583.

(60) Provisional application No. 61/654,494, filed on Jun. 1, 2012.

(51) Int. Cl.

| | |
|---|---|
| ***A63H 17/26*** | (2006.01) |
| ***A63H 33/00*** | (2006.01) |
| ***A63H 17/00*** | (2006.01) |
| ***A63H 17/02*** | (2006.01) |

(52) U.S. Cl.

CPC ..... *A63H 17/26* (2013.01); *A63H 17/008* (2013.01); *A63H 17/02* (2013.01); *A63H 33/003* (2013.01)

(58) Field of Classification Search

CPC ..... A63F 1/12; A63F 1/14

USPC ..... 273/149 R

See application file for complete search history.

(56) References Cited

U.S. PATENT DOCUMENTS

| | | | | |
|---|---|---|---|---|
| 491,558 | A | 2/1893 | Hill | |
| 750,988 | A | 2/1904 | Lotz | |
| 990,098 | A | 4/1911 | Black | |
| 1,029,469 | A | 6/1912 | Schrodel | |
| 1,156,047 | A | 10/1915 | Behrend | |
| 1,175,035 | A | 3/1916 | Wooster | |
| 2,327,047 | A | 8/1943 | Joyce | |
| 2,694,575 | A | 11/1954 | Paulson | |
| 3,025,846 | A | 3/1962 | Crosman | |
| 3,210,879 | A | 10/1965 | La Rue | |
| 3,640,177 | A | 2/1972 | Hottinger | |
| 3,641,704 | A * | 2/1972 | Sims | A63H 18/14 124/78 |

(Continued)

OTHER PUBLICATIONS

United States Patent and Trademark Office, Office Action for U.S. Appl. No. 13/907,261, dated Jan. 16, 2015, 10 pages.

(Continued)

*Primary Examiner* — John E. Simms, Jr.
*Assistant Examiner* — Dolores Collins
(74) *Attorney, Agent, or Firm* — Edell, Shapiro & Finnan, LLC

(57) ABSTRACT

A toy set is provided including a reconfigurable toy capable of transitioning between a first configuration and a second configuration. The toy set also includes a launch mechanism having an activation means and a toy receiver. A propulsion mechanism transfers movement of the activation means to the reconfigurable toy to propel the reconfigurable toy in a second configuration from the launch mechanism along a propulsion axis.

18 Claims, 13 Drawing Sheets

(56) References Cited

U.S. PATENT DOCUMENTS

| | | | | | |
|---|---|---|---|---|---|
| 3,662,147 | A | | 5/1972 | Ogden, Sr. et al. | |
| 3,711,096 | A | | 1/1973 | Cramp et al. | |
| 3,789,542 | A | | 2/1974 | Sims et al. | |
| 4,006,390 | A | | 2/1977 | Levine | |
| 4,155,552 | A | | 5/1979 | Jacobo et al. | |
| 4,206,564 | A | | 6/1980 | Ogawa | |
| 4,248,006 | A | | 2/1981 | Jones et al. | |
| 4,302,898 | A | | 12/1981 | Larue | |
| 4,318,388 | A | | 3/1982 | Fogarty et al. | |
| 4,393,620 | A | * | 7/1983 | Murakami | A63H 33/003 446/457 |
| 4,423,871 | A | * | 1/1984 | Mucaro | A63H 18/026 446/429 |
| 4,488,723 | A | | 12/1984 | LaGrow | |
| 4,642,066 | A | | 2/1987 | Kennedy et al. | |
| 4,690,658 | A | | 9/1987 | Crosson et al. | |
| 4,710,146 | A | | 12/1987 | Rasmussen et al. | |
| 5,254,030 | A | | 10/1993 | Ostendorft et al. | |
| 5,310,378 | A | * | 5/1994 | Shannon | A63H 33/004 446/268 |
| 5,333,867 | A | | 8/1994 | DiVito | |
| 6,000,992 | A | * | 12/1999 | Lambert | A63H 18/026 446/430 |
| 6,350,172 | B1 | | 2/2002 | Andrews | |
| 7,722,429 | B2 | * | 5/2010 | Campbell | A63H 33/003 446/376 |
| 7,724,426 | B2 | | 5/2010 | Yamashita et al. | |
| 7,766,720 | B2 | | 8/2010 | Ostendorff | |
| 7,942,721 | B2 | * | 5/2011 | Wade | A63H 17/02 446/429 |
| 7,950,979 | B2 | | 5/2011 | Barthold | |
| 8,336,521 | B2 | | 12/2012 | Tripathi et al. | |
| 8,336,531 | B2 | | 12/2012 | Fan et al. | |
| 8,337,271 | B2 | | 12/2012 | Campbell et al. | |
| 8,876,572 | B2 | | 11/2014 | Martino et al. | |
| 2002/0036104 | A1 | * | 3/2002 | Kerrebrock | B25J 9/08 180/6.2 |
| 2003/0220044 | A1 | * | 11/2003 | Andrews | A63H 13/10 446/268 |
| 2006/0270313 | A1 | * | 11/2006 | Campbell | A63H 33/003 446/431 |
| 2013/0157541 | A1 | | 6/2013 | Kafantaris et al. | |
| 2013/0192575 | A1 | | 8/2013 | Fan et al. | |
| 2017/0106303 | A1 | * | 4/2017 | O'Connor | A63H 18/02 |

OTHER PUBLICATIONS

United States Patent and Trademark Office, Office Action for U.S. Appl. No. 13/907,261, dated Mar. 2, 2016, 13 pages.

* cited by examiner

TRANSFORMABLE TOY AND LAUNCHER

CROSS REFERENCE TO RELATED APPLICATIONS

This application is a continuation of U.S. patent application Ser. No. 13/907,261 filed on May 31, 2013, which claims the benefit of U.S. Provisional Patent Application Ser. No. 61/654,494 filed on Jun. 1, 2012. The entire contents of the above applications are hereby incorporated by reference.

BACKGROUND

Toys are popular and provide entertainment and excitement to a user. Toys can be used alone or with other toys and may be used in conjunction with launch devices. In order to add additional play features to these toys it is desirable to provide them with additional features wherein the toys can change from one configuration to another configuration thus the user has in essence, two different types of toys provided by a single structure.

Accordingly, it is desirable to provide a toy that can transform from one configuration to another configuration, and to provide a launch mechanism that can be used with such a toy.

BRIEF SUMMARY OF INVENTION

In one embodiment a reconfigurable toy having a first configuration and a second configuration is provided including a main body. A front portion is pivotally connected to a first end of the main body for movement between a first position and a second position. A back portion is pivotally connected to a second end of the main body for movement between a third position and a fourth position. The toy also includes a retaining mechanism for holding the front portion in the second position and the back portion in the fourth position. Movement of the front portion between the first and second position and movement of the back portion between the third position and the fourth position cause the toy to transition between the first configuration and the second configuration.

In another embodiment a combination of a reconfigurable toy having a first configuration and a second configuration and a grasper configured to transform the toy between the first configuration and the second configuration while the toy is stored within a package is provided. The toy having: a main body; a front portion pivotally connected to a first end of the main body, the front portion being movable between a first position and a second position; a back portion rotatably connected to a second end of the main body, the back portion being movable between a third position and a fourth position; and a retaining mechanism for holding the front portion in the second position and the back portion in the fourth position; wherein movement of the front portion between the first and second position and movement of the back portion between the third position and the fourth position cause the toy to transition between the first configuration and the second configuration; and wherein the grasper has a generally semicircular upper portion that contacts a bottom surface of the main body of the toy and at least one tab extends inwardly from both ends of the upper portion adjacent the top surface of the main body to secure the grasper to the main body.

In yet another exemplary embodiment, a toy set is provided including a reconfigurable toy capable of transitioning between a first configuration and a second configuration. The toy set also includes a launch mechanism having an activation means and a toy receiver. A propulsion mechanism is configured to transfer movement of the activation means to the reconfigurable toy to propel the reconfigurable toy in a second configuration from the launch mechanism along a propulsion axis.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

In accordance with an exemplary embodiment of the present invention a reconfigurable toy 10 is provided. The toy 10 is capable of transitioning from a first configuration (see FIG. 1A) to a second configuration (see FIG. 1B). In one embodiment, the toy 10 resembles a car, automobile, or other land based vehicle first configuration and the toy 10 resembles a ball or other generally spherical object in the second configuration.

Figure 1A:
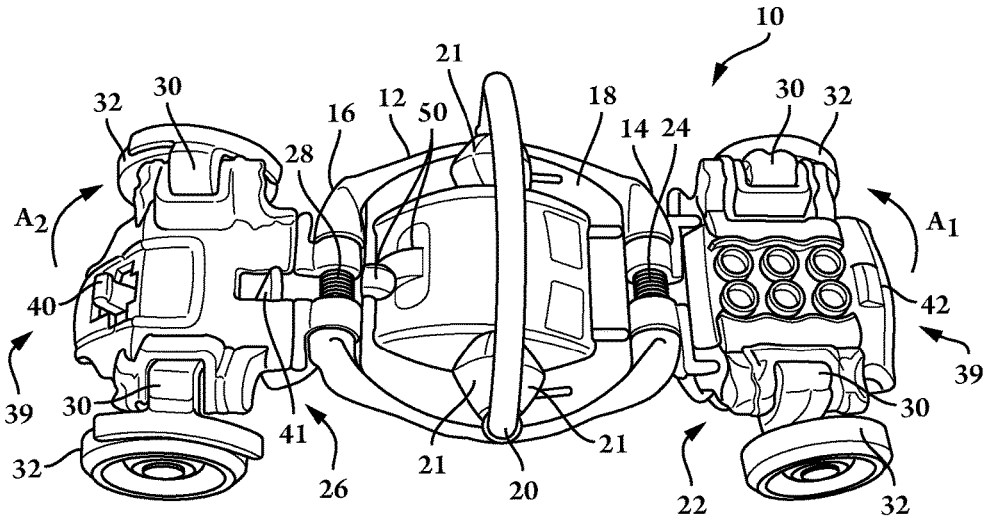
FIG. 1A is a perspective view of a toy in a first configuration.
Figure 1B:
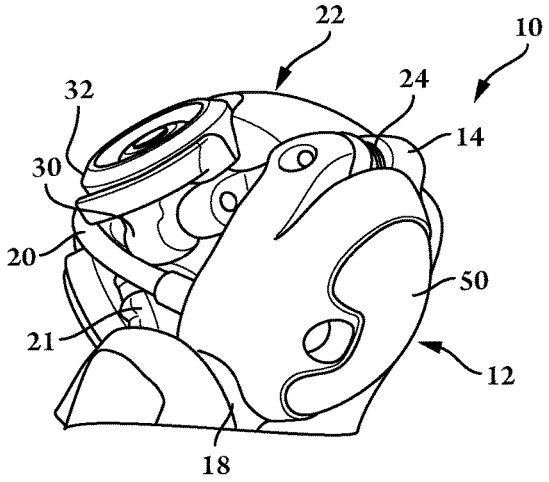
FIG. 1B is a perspective view of a toy in a second configuration.
Figure 1C:
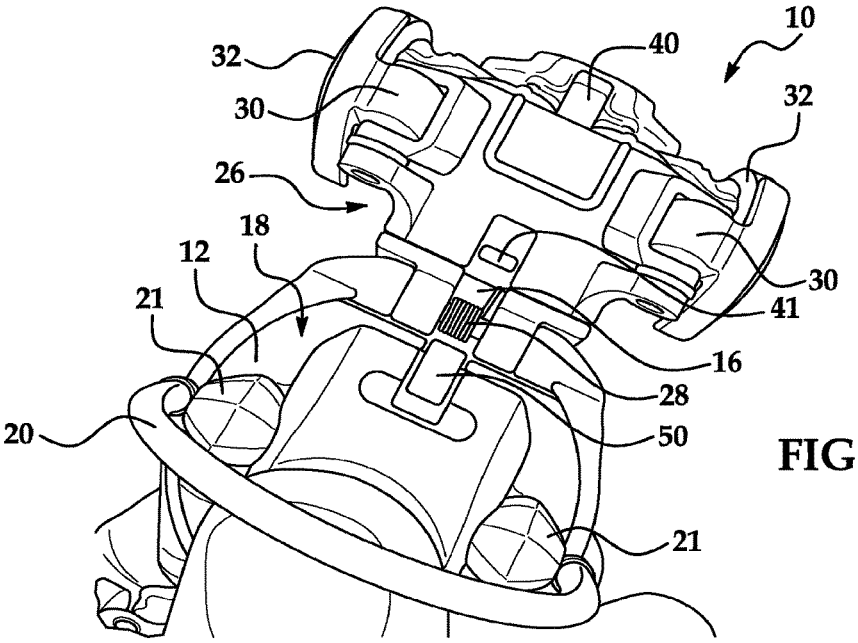
FIG. 1C is a perspective view of a toy in a first configuration.
Figure 2:
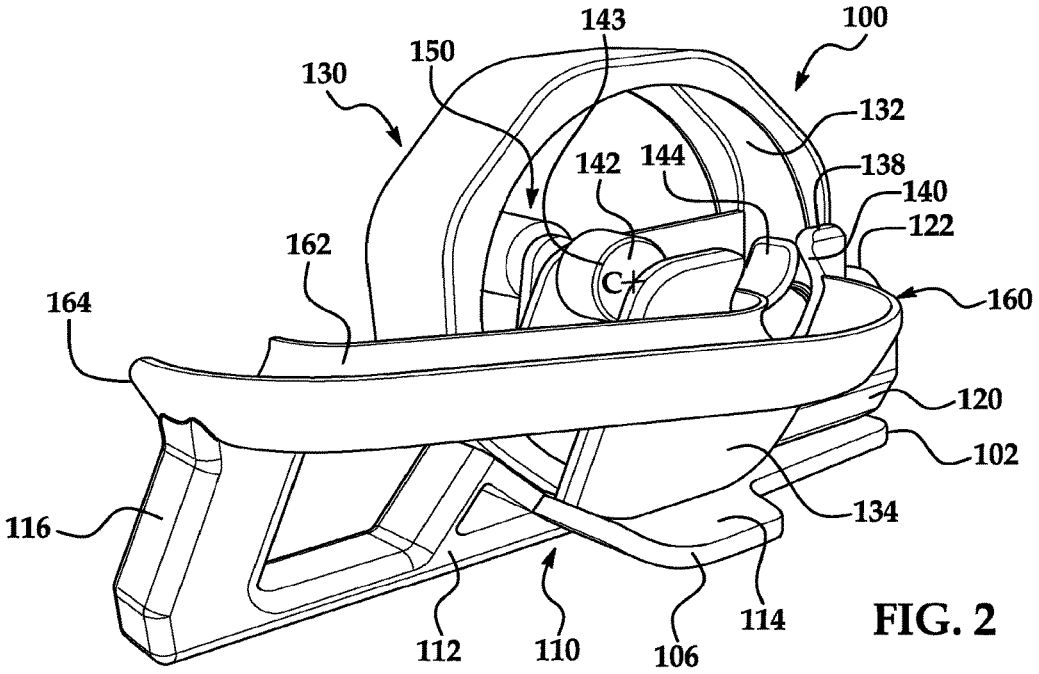
FIG. 2 is a perspective view of a first launch mechanism according to an embodiment of the invention.
Figure 3:
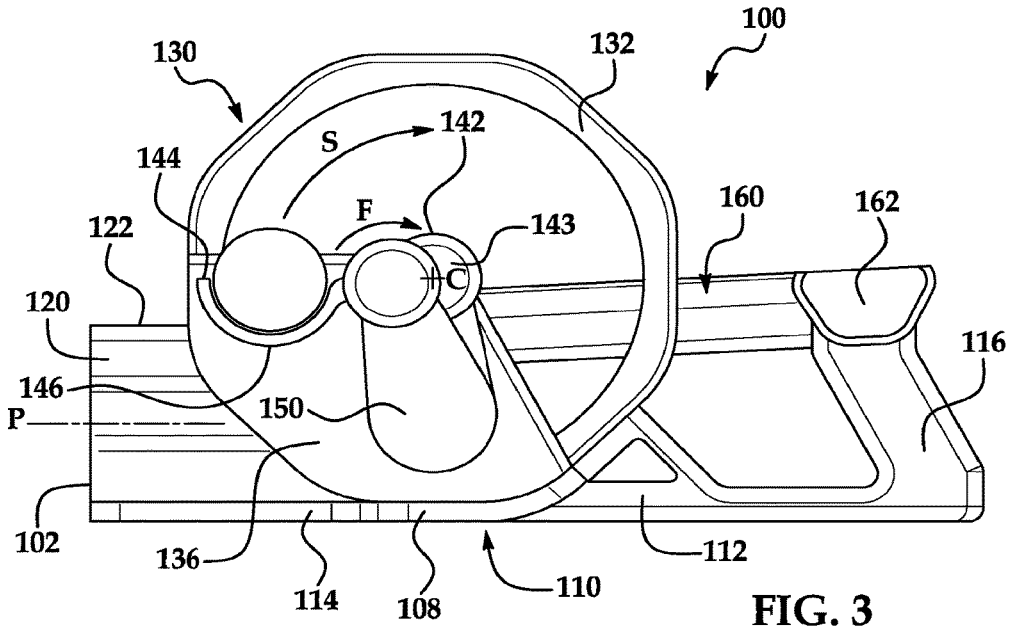
FIG. 3 is a side view of a first launch mechanism according to an embodiment of the invention.
Figure 4:
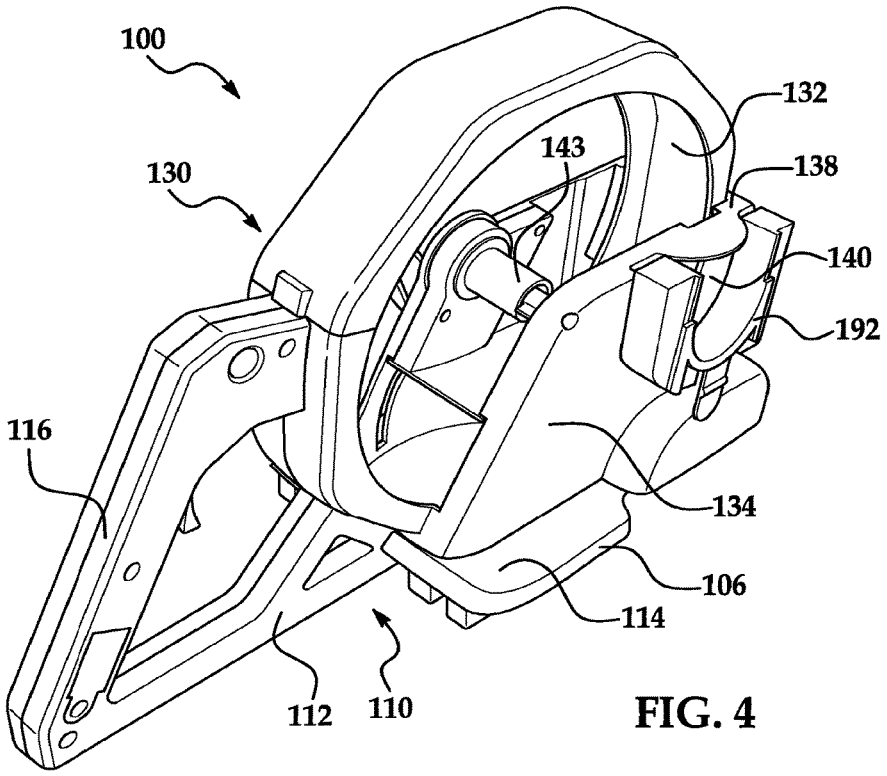
FIG. 4 is a perspective view of a first launch mechanism according to an embodiment of the invention.

Referring to FIGS. 1A-1C, a reconfigurable toy 10 is illustrated having a generally semicircular main body 12. A ring portion 20 is connected to a top surface 18 of the main body 12 and extends in a direction away from the main body 12. Adjacent each interface of the ring portion 20 and the top surface 18 is a cam surface 21. A front portion 22 is pivotally mounted to a first end 14 of the main body 12 with a first spring member 24. Similarly, a back portion 26 is pivotally mounted to a second, opposite end 16 of the main body 12 with a second spring member 28. The front portion 22 and back portion 26 each include at least one pivotable strut 30 having a rotatable wheel 32 coupled thereto. The strut 30 allows the rotatable wheel 32 to move between a vertical, deployed position when the toy 10 is in the first configuration (see FIG. 1A) and a horizontal, stowed position when the toy 10 is in the second configuration (see FIG. 1B). A spring member (not shown) may bias the strut 30 such that the rotatable wheel mounted to the strut is in the vertical, deployed position. In one embodiment, the front portion 22 and the back portion 26 each include two struts 32 disposed on opposing sides of the front portion 22 and back portion 26 respectively, such that the toy 10 resembles an automobile.

The front portion 22 and the back portion 26 of the toy 10 are movable between a first position, shown in FIG. 1A, and a second position, illustrated in FIG. 1B. When the toy 10 is in the first configuration, the front portion 22 and the back portion 26 are in a first position disposed on opposing sides of the main body 12 such that the back portion 26, the main body 12, and the front portion 22 are arranged generally linearly. To transform the toy 10 to the second configuration, the front portion 22 and the back portion 26 are rotated in the directions indicated by arrows A1 and A2 respectively, opposite the bias of the first and second spring members 24, 28, to a second position. In the second position, the front and back portions 22, 26 are positioned adjacent the top surface 18 of the main body 12 and the ring portion 20. While moving from the first position to the second position, the spring biased struts 30 contact the cam surfaces 21 adjacent the ring portion 20, causing the rotatable wheels 32 to pivot to a horizontal, stowed position. When the toy 10 is in the second configuration, the front and back portions 22, 26 form a semicircle complementary to the shape of the main body 12, such that the toy 10 has a generally round shape, similar to a ball.

Because the front and back portions 22, 26 are biased by the first and second spring member 24, 28 into the first position, the toy 10 may include a retaining mechanism 39 for retaining the front portion 22 and the back portion 26 in the second position. In one embodiment, the retaining mechanism 39 may include a hook 40 and an opening 42. For example, the back portion 26 includes hook 40 movable between an engaged position and a disengaged position (see FIG. 1C) and the front portion 22 includes opening 42 configured to receive the hook 40. The hook 40 may be spring biased into an engaged position, such that when the toy 10 is transformed to the second configuration and the front portion 22 and the back portion 26 are in the second position, the hook 40 engages the opening 42. In an alternate embodiment, the hook 40 may be located on the front portion 22, and the back portion 26 may include the opening 42 complementary to the hook 40.

Additionally, the top surface 18 of the main body 12 may include a spring biased button 50 indirectly coupled to the hook 40, such as with an arm member 41 for example. If the button 50 is pressed when the toy 10 is in the second configuration, such as by the force of the toy 10 hitting an object for example, the hook 40 will rotate to a disengaged position. The biasing force of the first and second spring members 24, 28 will cause the front portion 22 and the back portion 26 to rotate to a first position and the biasing force of the struts 30 will cause the wheels 32 to deploy.

Figure 15:
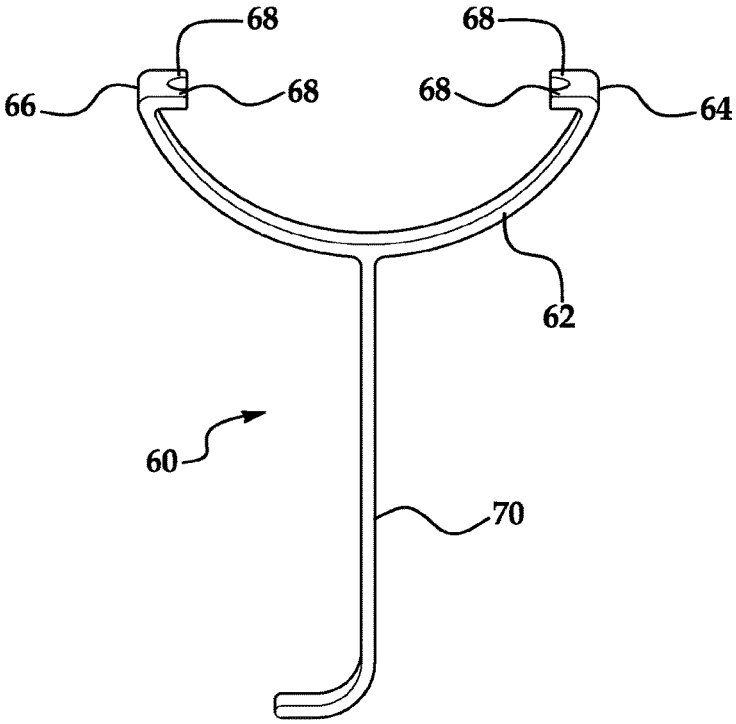
FIG. 15 is a perspective view of a grasper for use with a toy according to an embodiment of the invention.
Figure 16:
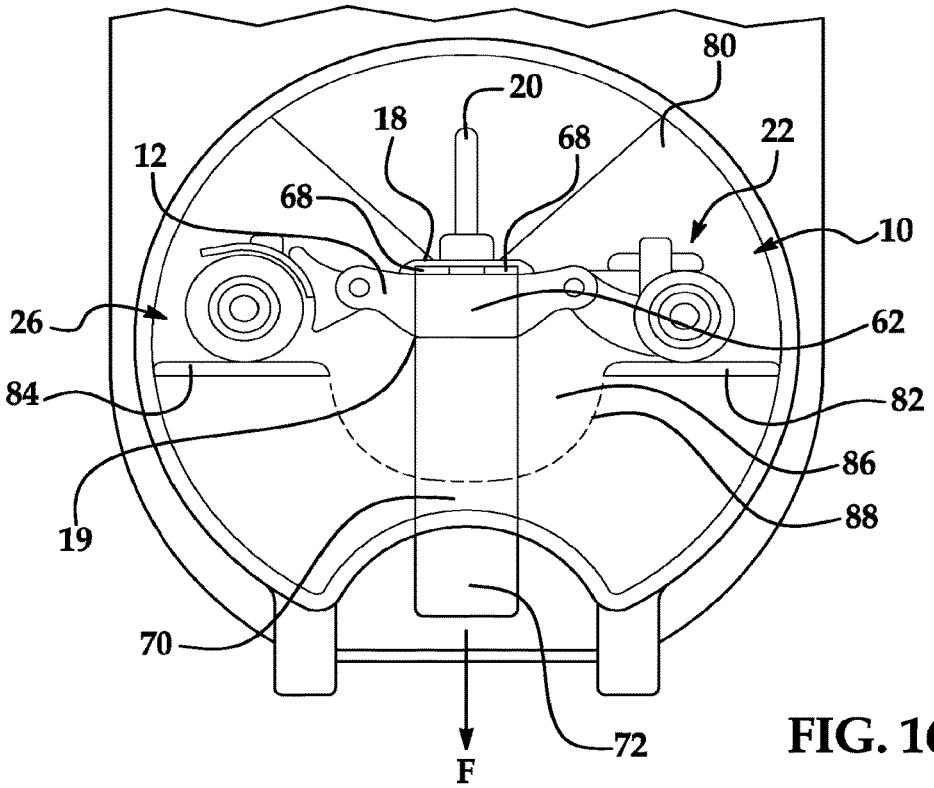
FIG. 16 is a front view of a packaged toy in a first configuration according to an embodiment of the invention.
Figure 17:
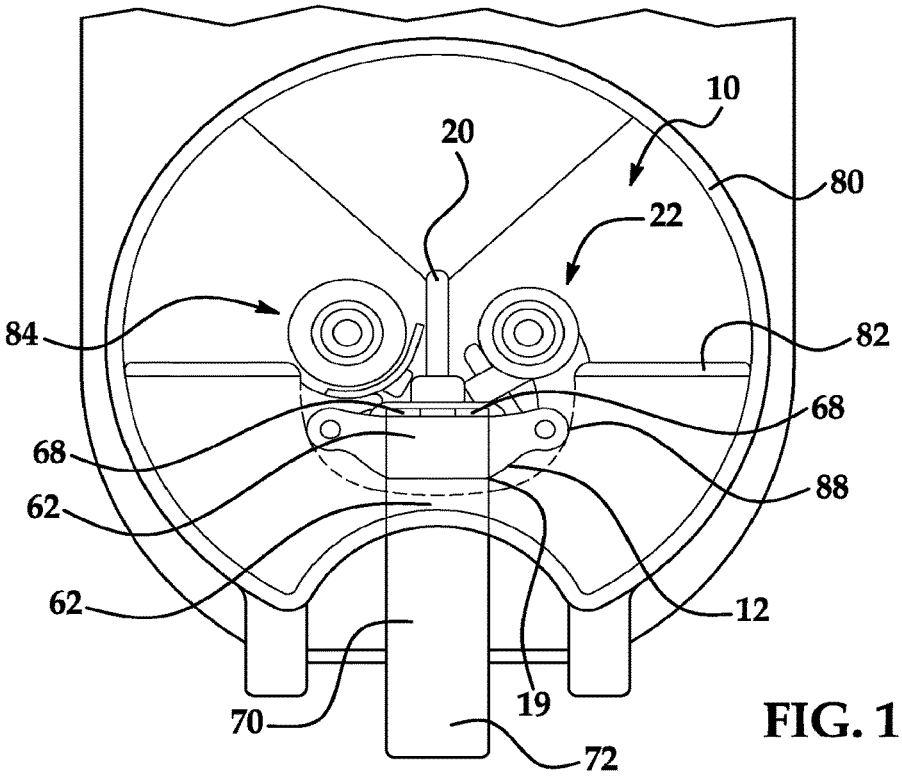
FIG. 17 is a front view of a packaged toy in a second configuration according to an embodiment of the invention.

Referring now to FIGS. 15-17, a grasper 60, may be used to transform the toy 10 between a first configuration and the second configuration while the toy 10 is stored within a package 80. The grasper 60 includes a generally semicircular upper portion 62 that contacts a bottom surface 19 of the main body 12 of the toy 10. At least one tab 68 extends inwardly from both the first end 64 and the second end 66 of the upper portion 62 adjacent the top surface 18 of the main body 12 to secure the grasper 60 to the main body 12. Mounted near the center of the upper portion 62 is a pull tab 70 that extends in a direction away from the upper portion 62 of the grasper 60 and the main body 12 of the toy 10. If a force is applied to the pull tab 70, the upper portion 62 and tabs 68 of the grasper 60 apply the force to the main body 12. In one embodiment, the free end 72 of the grasper 60 may be generally curved to provide an easier grip for a user applying a force to the pull tab 70.

The toy 10 may be stored within a package 80 having a first support arm 82 and a second support arm 84. The front portion 22 of the toy 10 is supported by the first support arm 82 and the back portion 26 of the toy 10 is supported by the second support arm 84. The first support arm 82 and the second support arm 84 define an opening 86 there between. A connector 88, may extend between the first support arm 82 and the second support arm 84 such that the opening 86 has a generally semicircular contour configured to receive a portion of the toy 10 in the second configuration. The interface between the opening 86 and the connector 88 is illustrated with a dotted line for clarity. A portion of the grasper 60, such as the free end 72 of the pull tab 70 for example, may be accessible through the packaging 80 by a prospective buyer of the toy 10. In one embodiment, the toy 10 may be stored within a bubble, and the free end 72 of the pull tab 70 may extend through an opening in the bubble.

If a user applies a force F to the pull tab 70 extending from the packaging (see FIG. 16), the toy 10 will transform from the first configuration to the second configuration (see FIG. 17). The force F is transferred to the main body 12 via the grasper 60. In addition, the first support arm 82 and the second support arm 84 limit movement of the front portion 22 and the back portion 26 such that the front portion 22 and the back portion 26 of the toy 10 rotate from the first position to the second position. When the force F applied to the free end 72 of the pull tab 70 is removed, the first spring member 24 and the second spring member 28 bias the front portion 22 and the back portion 26 into the first position.

In one non-limiting embodiment, the transformable toy 10 is intended for use with a launch mechanism 100, to propel to toy 10 along a propulsion axis P. Referring now to FIGS. 2-6, in one embodiment a launch mechanism 100 includes a base 110, an activation means 150, and a propulsion mechanism 130. The launch mechanism 100 may include a first base portion 112 and a second base portion 114 configured to rest upon a planar support surface, such as a tabletop or floor for example. The first and second base portions 112, 114 are sized and located such that the launch mechanism 100 is self-supported when rested on the planar surface. The first and second base portions 112, 114 maintain the launch mechanism 100 in an upright, stable position, and prevent the launch mechanism 100 from falling on its side. A generally cylindrical chute 120 is positioned adjacent a front end 102 of the launch mechanism 100. In one embodiment, the chute 120 may be formed integrally with the base 110 and a portion of the propulsion system 130. The launch mechanism 100 may also include a handle 116 formed between a portion of the base 110 and the propulsion mechanism 130 or between a portion of the base 110 and a feed mechanism 160.

The toy propulsion mechanism 130 is configured to propel a toy 10 from the launch mechanism 100 along a propulsion axis P through the chute 120. An interior facing circular track 132 is mounted to a top surface 122 of the chute 120, and extends approximately 270 degrees to the base 110 of the launch mechanism 100. First and second side supports 134, 136 extend perpendicularly from the second base 114 adjacent a first side 106 and a second side 108 of the launch mechanism 100. In one embodiment, the first side support 134 and the second side support 136 extend to the center C of the circle formed by the circular track 132 and to the interface between the circular track 132 and the chute 120. Adjacent an upper edge 138 of the first side support 134 is a hole 140 for receiving a toy 10, such as toy 10 in a second configuration for example. A toy receiver 142, such as a scoop for example, is pivotally mounted at a first end 143 to at least one of the first and second side supports 134, 136 for rotation about the center C of the circular track 132 in the direction indicated by arrow S. The length of the toy receiver 142 may be approximately equal to the radius of the circular track 132. In one embodiment, the free end 144 of the toy receiver 142 includes a groove 146 for supporting a toy 10 in a second configuration. In a first position, illustrated in FIG. 2, the toy receiver 142 is positioned adjacent the hole 140 in the first side support 134 to receive a toy 10 to be launched.

An activation means 150, such as a crank or a lever for example, is mounted to the second side support 136. In embodiments where there activation means 150 is a lever, a spring member (not shown) is positioned at the coupling between the activation means 150 and the second side support 136 to bias the activation means 150 into a first, inactive position (see FIG. 6). The propulsion mechanism 130 couples the activation means 150 to the toy receiver 142 to transfer movement of the activation means 150 to the toy 10. In one embodiment, the activation means 150 may be directly coupled to the toy receiver 142 such that a full rotation of the activation means 150 causes a full rotation of the toy receiver 142. Alternatively, the activation means 150 may be indirectly coupled to the toy receiver 142, such as with a gear train (not shown) for example. In such instances, only partial movement of the activation means 150 is required to generate a full rotation of the toy receiver 142.

To operate the launch mechanism 100, a toy 10 is inserted onto the toy receiver 142 through hole 140 in the first side support 134. A force F is then applied to pivot the activation means 150, thereby causing a launch event. The rotation of the activation means 150 causes the toy receiver 142 to rotate in the direction indicated by arrow S. As the toy receiver 142 rotates about the circular track 132, the centripetal force causes the toy 10 to remain engaged with the toy receiver 142. Once the toy receiver 142 is in a position adjacent the base 110, the toy receiver 142 propels the toy 10 through the chute 120 along the propulsion axis P.

Toys 10 may be fed to into the toy receiver 142 through the hole 140 in the first side support 134 manually. Alternatively, the launch mechanism 100 may include a feed mechanism 160 to feed toys 10 onto the toy receiver 142 automatically. In one embodiment, illustrated in FIGS. 2 and 3, the feed mechanism 160 may include an angled track 162 that extends from adjacent the hole 140 in the first side support 134, such that a plurality of toys 10 may be retained within the track 162. The free end of the track 164, may be supported by a portion of the base 110. Gravity will cause the toys 10 to roll down the track 162, through the hole 140, and into engagement with the toy receiver 142.

Figure 5:
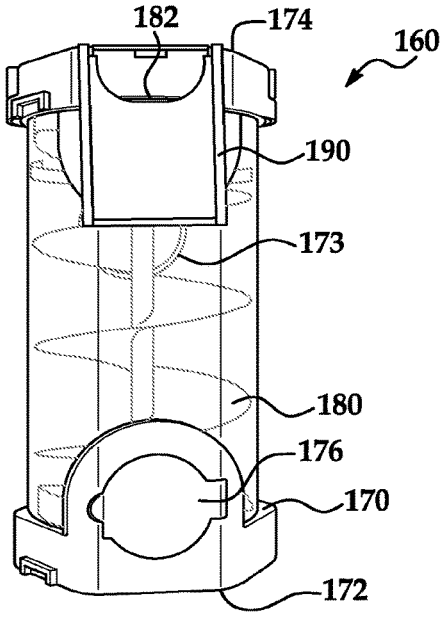
FIG. 5 is a front view of a feed mechanism for use with the first launch mechanism according to an embodiment of the invention.
Figure 6:
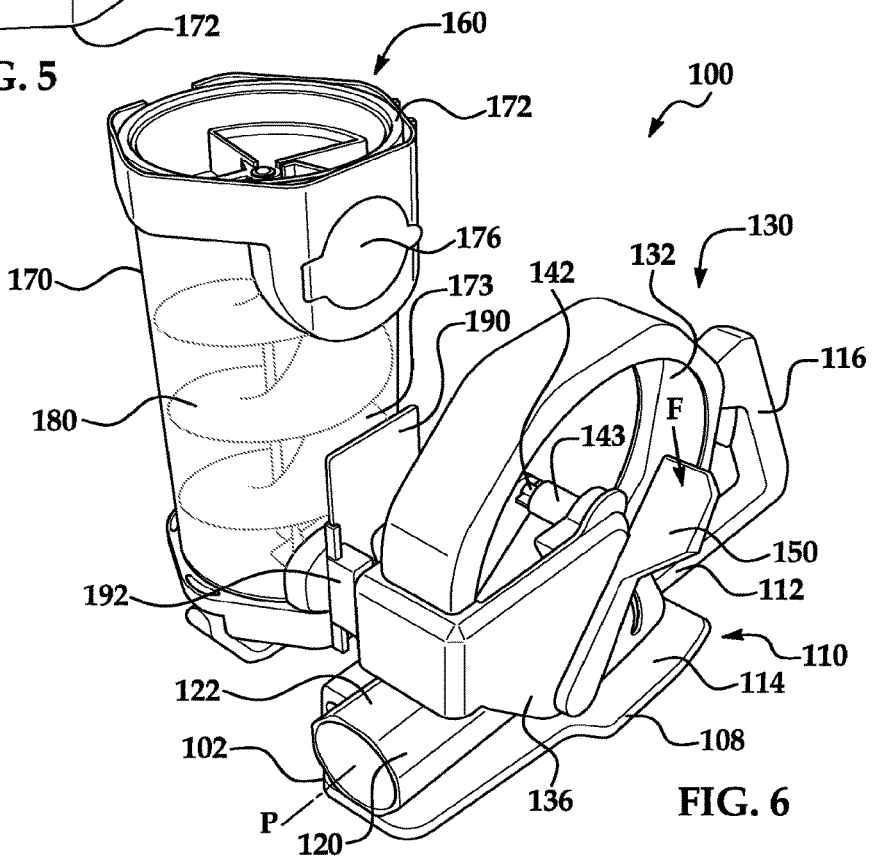
FIG. 6 is a perspective view of a first launch mechanism according to an embodiment of the invention.

In another embodiment, illustrated in FIGS. 5 and 6, the feed mechanism 160 includes a canister 170 capable of storing a plurality of toys 10 to be fed to the launch mechanism 100. Adjacent a first end 172 of the canister 170 is a 176 door, through which a toy 10 in a second configuration may be inserted. Disposed within the canister 170 is a spiral track 180 that extends from adjacent the door 176, to a second end 174 of the canister 170. Mounted adjacent the second end 174 of the canister 170, aligned with the door 176, is a first mating piece 190 slidable relative to the surface 173 of the canister 170 between a first position (see FIG. 5) and a second position (see FIG. 6). When the first mating piece 190 is moved to the second position, an opening 182, through which toys 10 in a second configuration exit the canister 170, is exposed. A complementary second mating piece 192 (see FIG. 4) is mounted to the first side support 134 adjacent hole 140. As the first mating piece 190 engages the second mating piece 192, the first mating piece 190 slides to a second position to expose opening 182. The opening 182 of the canister 170 and the hole 140 in the first side support 134 are aligned, thereby allowing toys 10 to travel from the canister 170 to the toy receiver 142.

Figure 7:
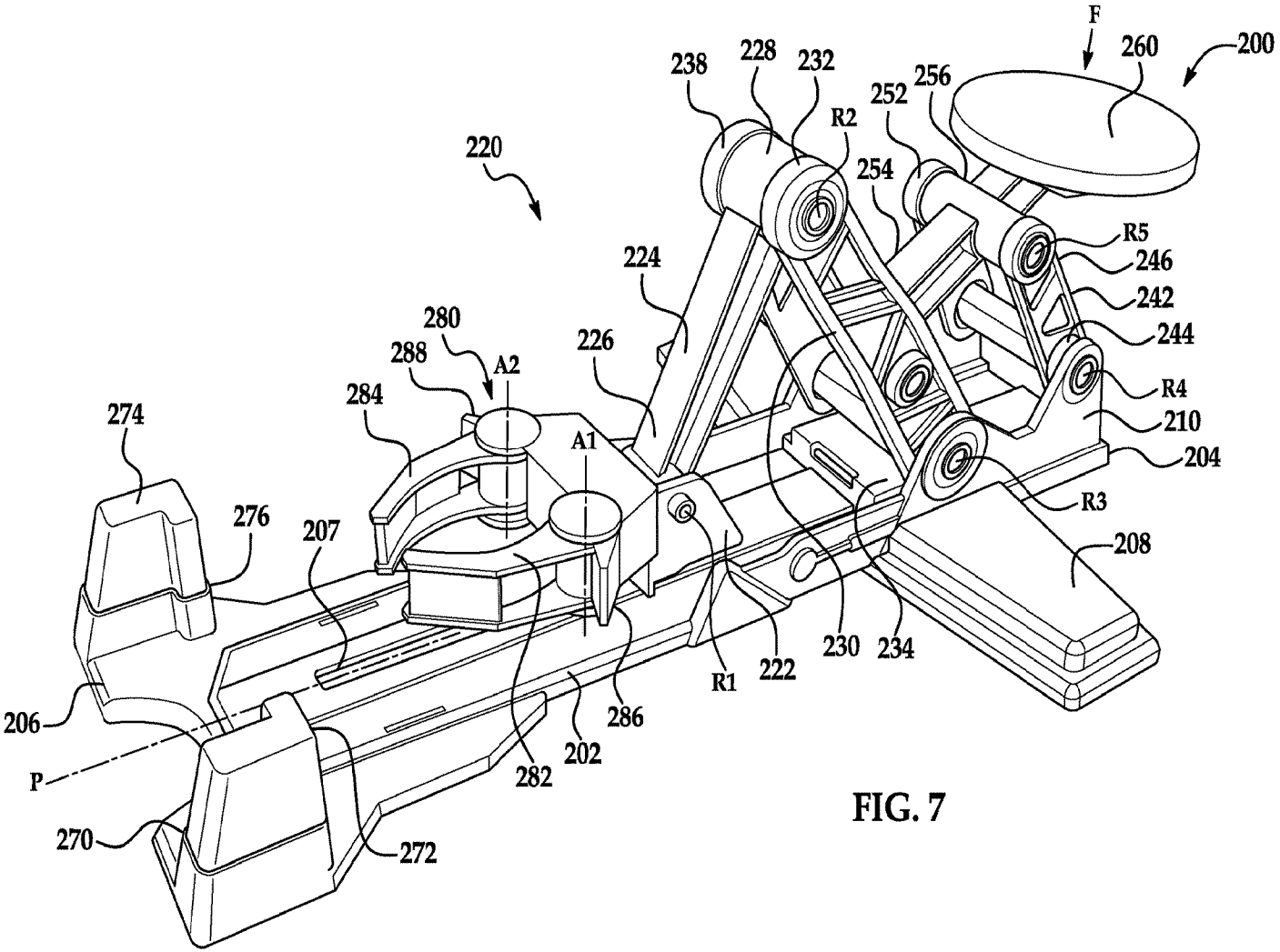
FIG. 7 is a perspective view of a second launch mechanism according to an embodiment of the invention.
Figure 8:
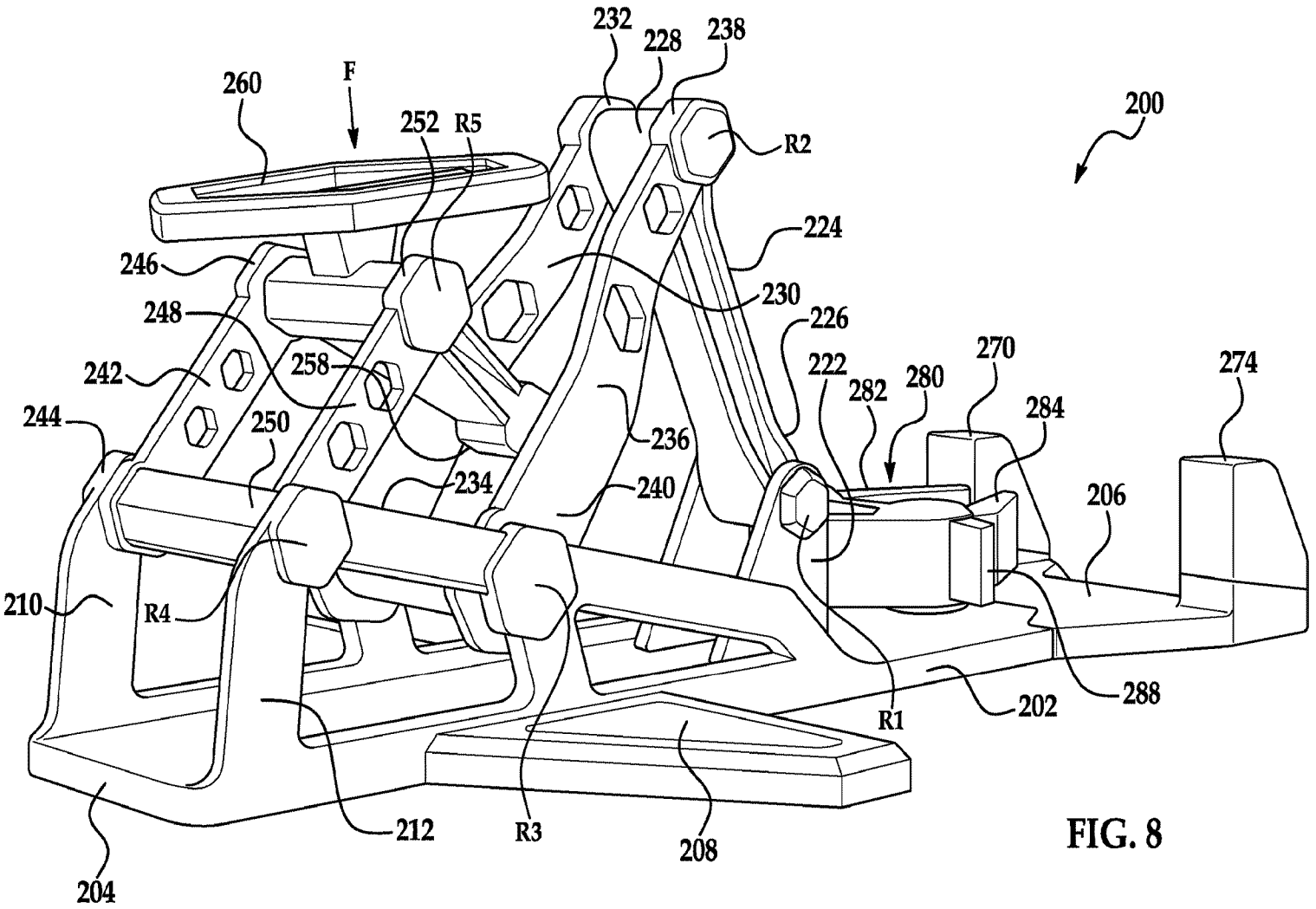
FIG. 8 is a perspective view of a second launch mechanism according to an embodiment of the invention.
Figure 9:
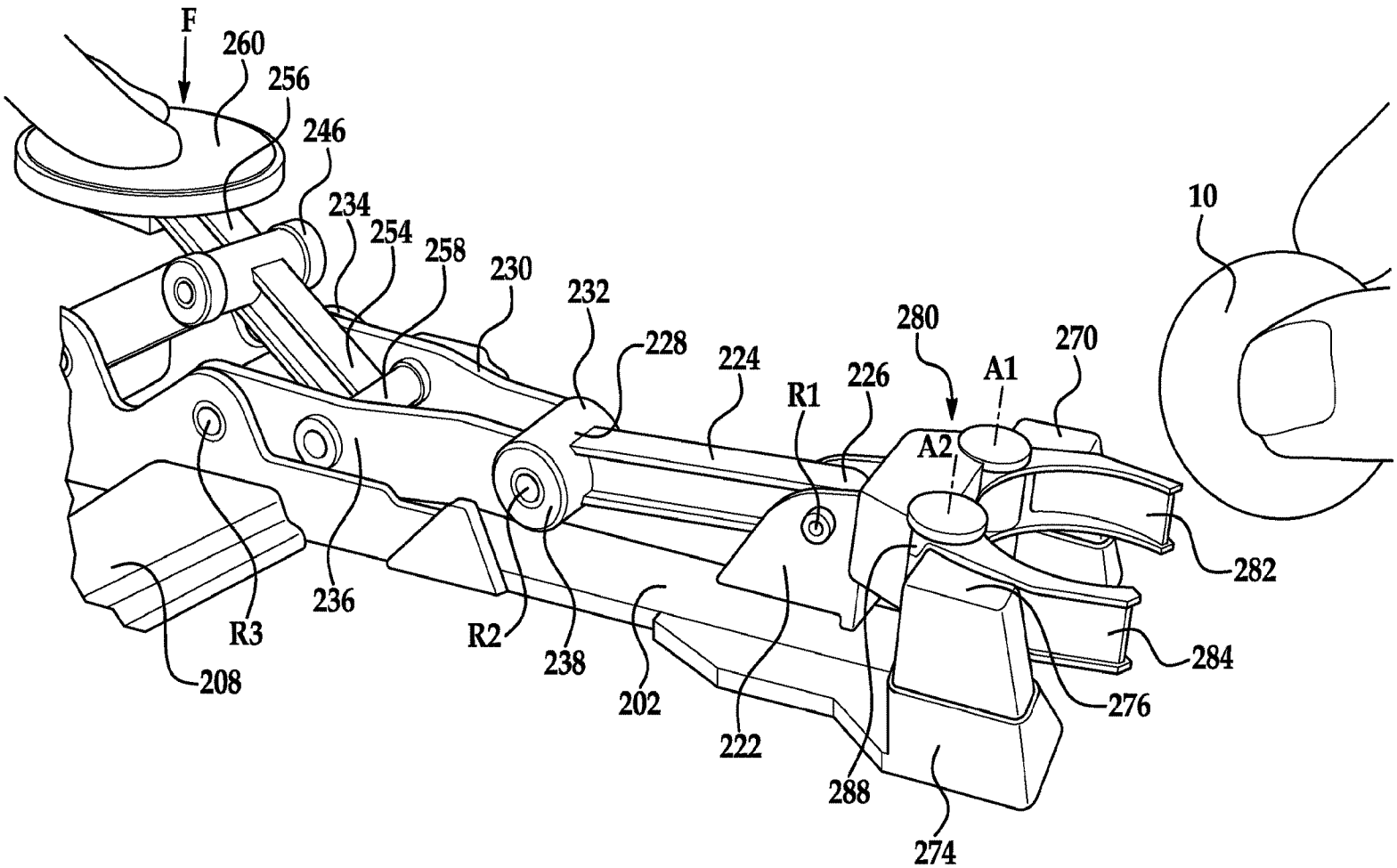
FIG. 9 is a perspective view of a second launch mechanism according to an embodiment of the invention.

Referring now to FIGS. 7-9, an alternate launch mechanism 200 for use with the reconfigurable toy 10 is illustrated. The launch mechanism 200 includes a flat, generally rectangular base 202 for supporting the launch mechanism 200 on a planar surface. An additional base support 208 may be positioned adjacent opposing sides of the base 202 to improve the stability of the launch mechanism 200 on a surface. A first sidewall 210 and a second, opposing sidewall 212 extend perpendicular to the base 202 adjacent a first end 204.

A sliding support 222 of the propulsion mechanism 220 is slidably engaged with the base 202 to propel a toy 10 from the launch mechanism 200 along a propulsion axis P. A portion of the sliding support 222 is disposed within an elongated slot 207 of the base 202, such that activation of the propulsion mechanism 220 causes the sliding support 222 and a toy receiver 280 fixed to the sliding support 222 to translate within the slot 207, relative to the base 202. In one embodiment, the toy receiver 280 is a claw having a first arm 282 and second arm 284 rotatable about axes A1 and A2 respectively to grasp a toy 10. A first flange 286 extends from a portion of the first arm 282, and a second flange 288 extends from a portion of the second arm 284. The first arm 282 and the second arm 284 may include spring members (not shown) that bias the arms in opposite directions, towards one another.

In one embodiment, the propulsion system 220 includes a plurality of links that transfer the motion of a launch event to the sliding support 222 and the toy receiver 280. A first link 224 is coupled to the sliding support 222 by a pin R1 at a first end 226. The second end 228 of the first link 224 is coupled to a first end 232 of a second link 230 by a pin R2. The second end 234 of the second link 230 is coupled to a first sidewall 210 at pin R3. A spring member (not shown) may be mounted to the second end 234 of the second link 230 about pin R3. The spring member provides a biasing force causing the second link 230 to rotate in the direction indicated by arrow B3. In one embodiment, a third link 236, identical to the second link 230, is similarly coupled at a first end 238 to the first link 224 about pin R2 and at a second end 240 to the second sidewall 212 at pin R3. In such instances, the second end 228 of the first link 224 may be positioned between the first end 232, 238 of the second link 230 and the third link 236, such that the first link 224 is centered along pin R2. A first end 244 of a fourth link 242 is coupled to the first sidewall 210 adjacent the first end 204 for rotation about pin R4 and is coupled at a second end 246 about pin R5 to an activation means 260, such as a handle or lever for example. In one embodiment, a fifth link 248, identical to the fourth link 242, may be pivotally coupled at a first end 250 to the second sidewall 212 about pin R4 and coupled at a second end 252 to the activation means 260 about pin R5. The activation means 260 may be disposed between the second end 246, 252 of the fourth and fifth links 242, 248 about pin R5. A sixth link 254 is coupled at a first end 256 about pin R5, and is coupled at a second end 258 to the middle of the second link 230.

To generate a launch event, a force F is applied to the activation means 260 causing the series of links 224, 230, 236, 242, 248, 254 to rotate relative to one another to an extended launch position (see FIG. 9), thereby moving the sliding support 222 within the elongated slot 207, towards the second end 206 of the base 202. A first and second endpiece 270, 274 are disposed on opposing sides of the propulsion axis P adjacent the second end 206 of the base 202. Each endpiece 270, 274 includes a foot 272, 276 that extends in the direction of the opposite endpiece. When the propulsion mechanism 220 is in a launch position, the toy receiver 280 is positioned adjacent the endpieces 270, 274. The foot 272 of the first endpiece 270 engages the first flange 286 and the foot 276 of the second endpiece 274 engages the second flange 288 of the toy receiver 280, thereby opening the arms 282, 284 of the toy receiver 280 to either grab or release a toy 10. When the force F is removed from the activation means 260, the biasing force of the spring member causes the second link to rotate about pin R3 to a first position (see FIG. 7), such that all of the links 224, 230, 236, 242, 248, 254 in the propulsion mechanism 220 return to a first position.

FIGS. 10-13 illustrate another alternate launch mechanism 300 including a first base 302 and a second base 308. A first base 302 is generally rectangular and extends along the length of the launch mechanism 300. A second base 308 is positioned perpendicular to the first base 302 and rests upon a planar surface. A first end 304 of the first base 302 is mounted to the second base 308, such that the first base 302 is at a slight incline to the planar surface. The first base 302 includes an elongated slot 310 adjacent a second end 306. A propulsion mechanism 320 is slidably engaged with the first base 302. The propulsion mechanism 320 includes a trigger 322 disposed within the elongated slot 310, and coupled to the first base 302 with a spring member (not shown). The trigger includes a first protrusion 328 adjacent a first end 324 and a second protrusion 329 adjacent a second, opposite end 326.

Figure 10:
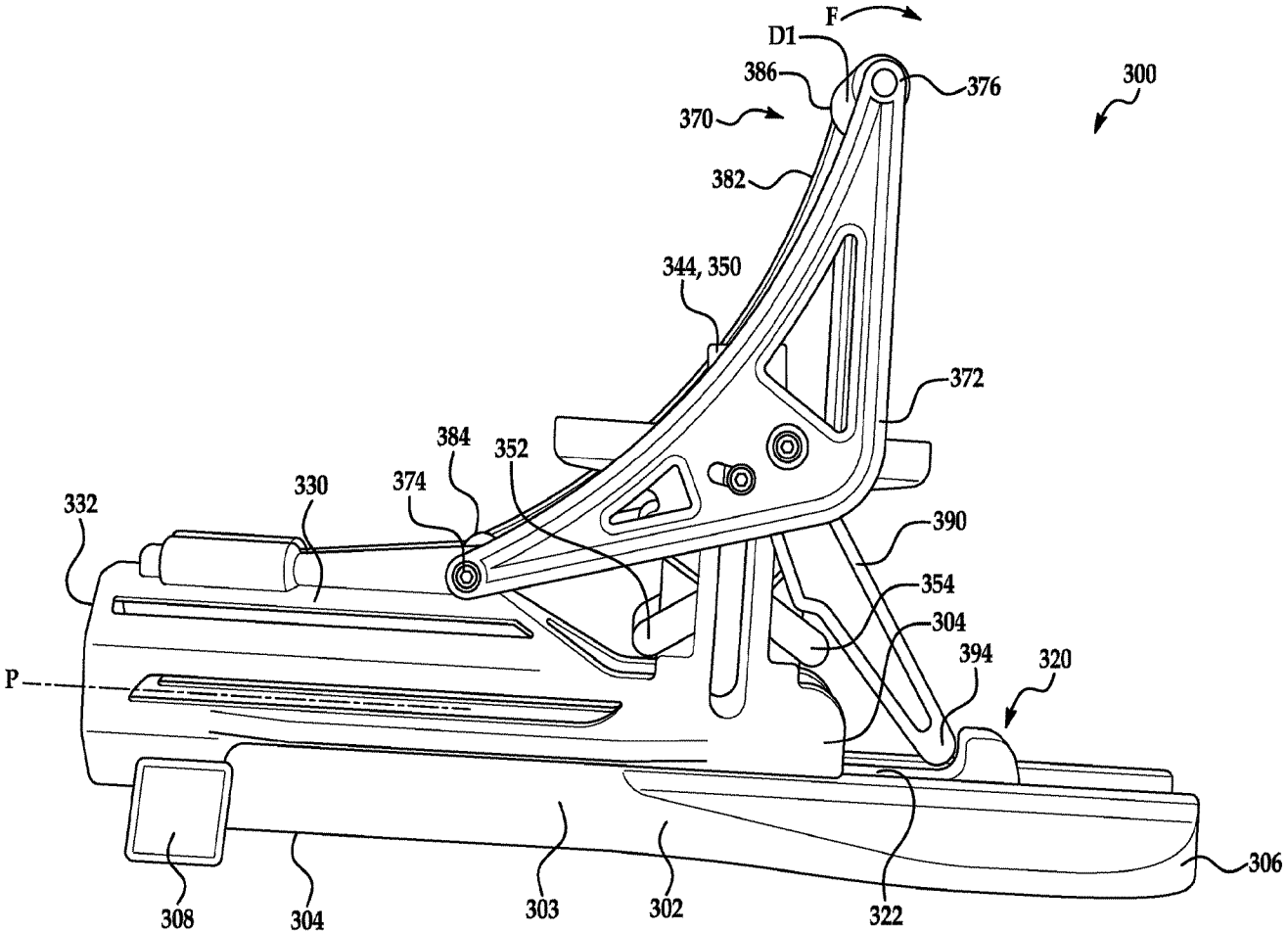
FIG. 10 is a side view of a third launch mechanism according to an embodiment of the invention.
Figure 11:
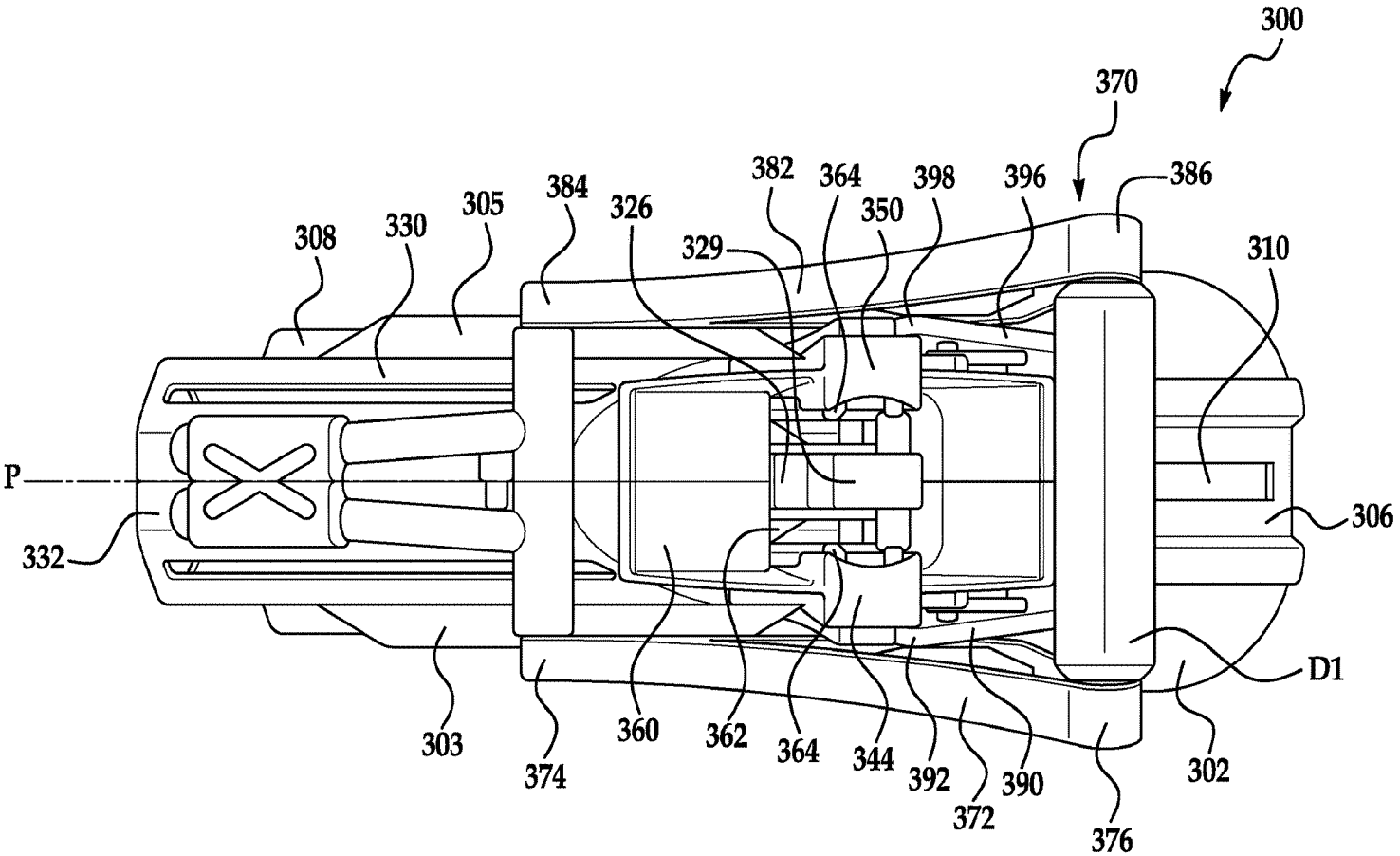
FIG. 11 is a top view of a third launch mechanism according to an embodiment of the invention.
Figure 12:
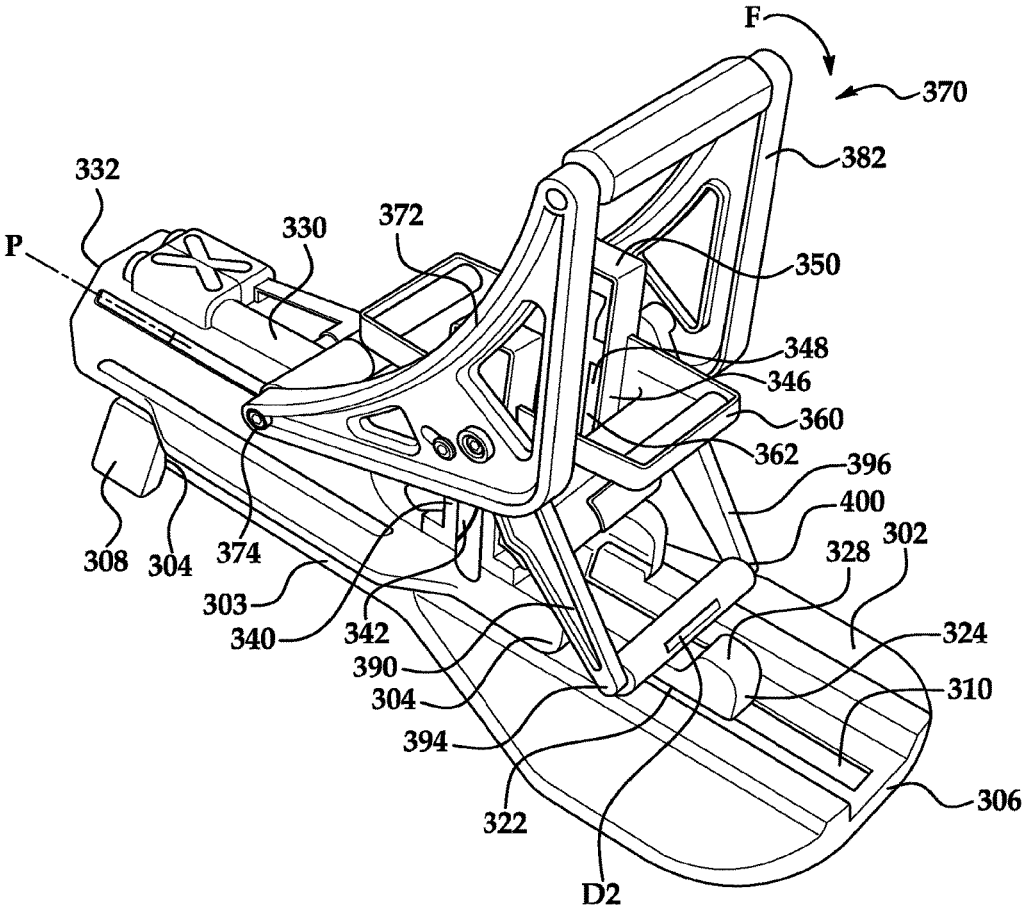
FIG. 12 is a perspective view of a third launch mechanism according to an embodiment of the invention.
Figure 13:
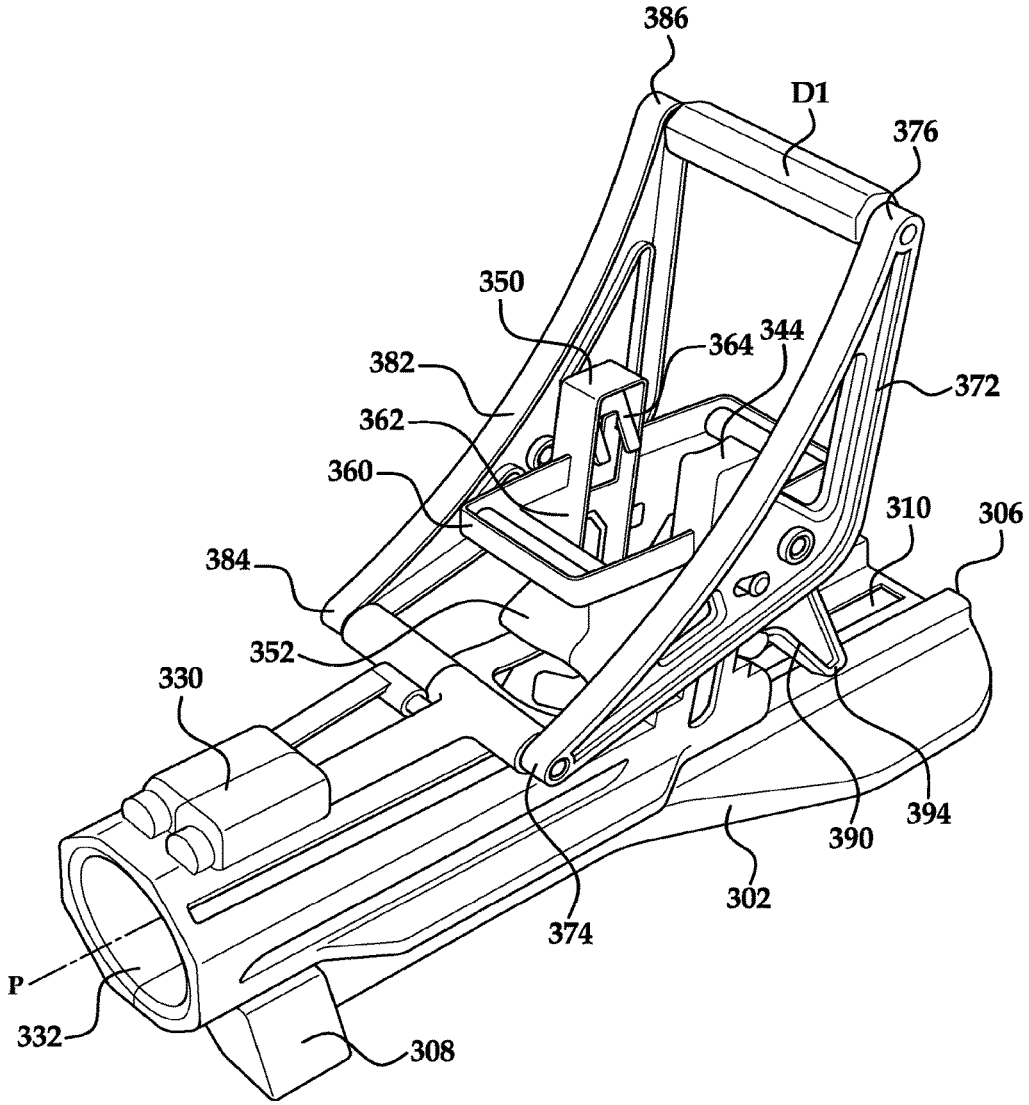
FIG. 13 is a perspective view of a third launch mechanism according to an embodiment of the invention.

A hollow, generally cylindrical chute 330 is mounted to a top surface 307, 309 of the first and second base 302, 308 respectively, as illustrated in FIG. 10. The first end 332 of the chute 330 extends a distance beyond the second base 308, and the second end 334 of the chute 330 is located in the middle of the first base 302. Adjacent the second end 334 of the chute 330, a pair of parallel toy receiver supports 340, 346, each having a channel 342, 348, extend perpendicular to the chute 330. In one embodiment, first and second angled supports 352, 354 extend between the pair of toy receiver supports 340, 346 in the direction of the base 302. The first angled support 352 may be disposed between the first end 332 and the second end 334 of the chute 330, and the second angled support 354 may be adjacent the second end 334 of the chute 330. Mounted near the free ends 344, 350 of the toy receiver supports 340, 346 is a toy receiver 360, such as a tray for example, for receiving a toy 10 in a first configuration. The toy receiver 360 includes a hole 362 between the toy receiver supports 340, 346. In one embodiment, the hole 362 is at least the size of a toy 10 in the second configuration.

An activation means 370, such as a lever for example, is coupled to the propulsion mechanism 320 to launch the toy 10. A first side panel 372 is positioned adjacent a first side 303 of the launch mechanism 300, and a second side panel 382 is positioned adjacent a second side 305 of the launch mechanism 300. A first end 374, 384 of both the first and second side panels 372, 382 is pivotally mounted to a portion chute 330. The second end 376, 386 of both the first and second side panels 372, 382 are connected using a dowel D1. A toy engagement prong 364 (see FIG. 13) is positioned adjacent the interior of each toy receiver support 340, 346, and is connected, through the channel 342, 348, to a portion of a respective side panel 372, 382. A first end 392 of a first link 390 is pivotally mounted to a portion of the first side panel 372, and a first end 398 of a second link 396 is pivotally mounted to a portion of the second side panel 382. The second end 394, 400 of both the first link 390 and the second link 396 are connected with another dowel D2. In an inactive position, shown in FIG. 10, the links 390, 396 extend at an angle from the side panels 372, 382 towards the first base 302, such that dowel D2 is adjacent the first protrusion 328 of the trigger 322.

To operate the launch mechanism 300, a toy 10 in a first configuration is inserted by a user into the toy receiver 360. Application of a force F to the dowel D1, causes the activation means 370 to rotate relative to the chute 330, and the toy engagement prongs 364 to translate within their respective channels 342, 348. The toy engagement prongs 364 engage and apply a force to the main body 12 of the toy 10 in the first configuration. Because of the shape of the toy receiver 360, application of a force by the toy engagement prongs 364 to the main body 12 causes the front portion 22 and the back portion 26 of the toy 10 to rotate, thus transforming the toy 10 to a second configuration to fit through hole 362. Rotation of the activation means 370 relative to the chute 330 also causes the second dowel D2 to engage and move the first protrusion 328 of the trigger 322 to an end of the elongated slot 310. In this launch position, the second protrusion 329 of the trigger 322 is located adjacent the second end 334 of the chute 330. Once the toy 10 transforms to the second configuration, the toy 10 drops from the toy receiver 360 to the first base 302 and into contact with the second protrusion 329. In the launch position, the spring member of the propulsion mechanism is in tension. Once the force F on the activation means 370 is released, the biasing force of the spring member will cause the trigger 322 to slide within the elongated slot 310. The second protrusion 329 pushes the toy 10 as the trigger 322 slides, thereby launching the toy 10 in the second configuration along a propulsion axis P out of the chute 330.

Figure 14:
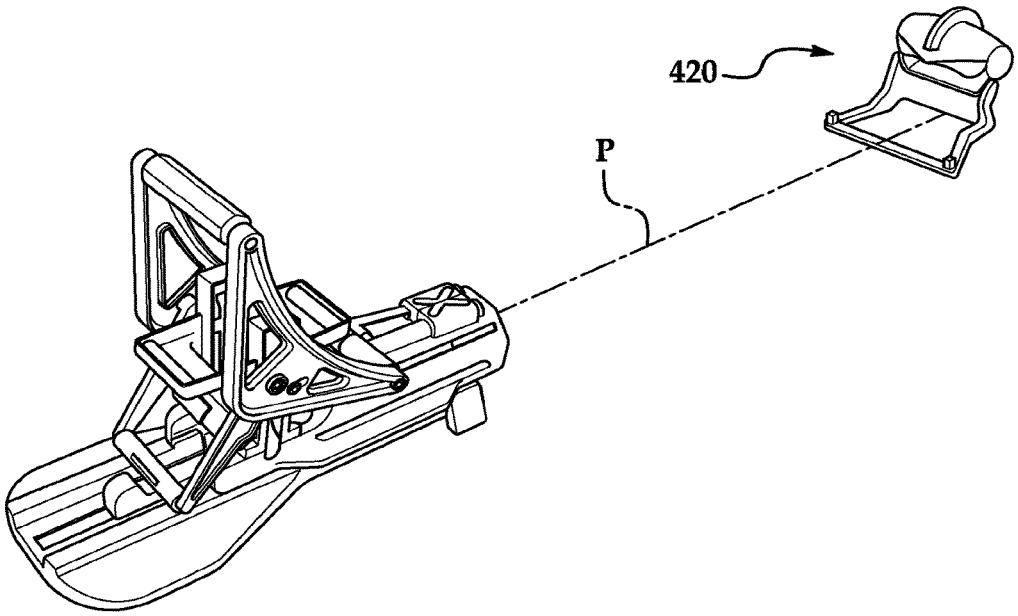
FIG. 14 is a perspective view of a third launch mechanism and a target according to an embodiment of the invention.

In one embodiment, a target 420, shown in FIG. 14, may be spaced a distance from the launch mechanism 300, along the propulsion axis P. When the toy 10 contacts a surface of the target 420, the toy 10 force causes the retaining mechanism 39 to disengage such that the front portion 22 and the back portion 26 of the toy 10 rotate to a first position, thereby transforming the toy 10 from the second configuration back to a first configuration.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A toy set, comprising:

a reconfigurable toy configured to transition between a first configuration and a second configuration, the reconfigurable toy comprising:

a main body;

a front portion rotatably connected to the main body, the front portion being movable between a first position and a second position;

a back portion rotatably connected to the main body, the back portion being movable between a third position and a fourth position; and a retaining mechanism for retaining the front portion in the second position and the back portion in the fourth position;

wherein, when the retaining mechanism retains the front portion and the back portion, the retaining mechanism prevents movement of the front portion from the second position to the first position and prevents movement of the back portion from the fourth position to the third position, and wherein, when the retaining mechanism does not retain the front portion and the back portion, movement of the front portion between the first position and the second position and movement of the back portion between the third position and the fourth position cause the toy to transition between the first configuration and the second configuration; and a launch mechanism, including:

a toy receiver configured to receive the reconfigurable toy, an activator configured to be moved by a user, and a propulsion mechanism configured to transfer movement of the activator to the toy receiver to propel the received reconfigurable toy along a propulsion axis.

2. The toy set of claim 1, wherein the reconfigurable toy resembles a toy vehicle in the first configuration.

3. The toy set of claim 1, wherein the reconfigurable toy resembles a ball in the second configuration.

4. The toy set of claim 1, wherein the toy receiver is configured to receive the reconfigurable toy in the second configuration, and wherein the propulsion mechanism is configured to propel the received reconfigurable toy in the second configuration.

5. The toy set of claim 4, wherein the toy receiver is a claw having movable first and second arms, the first and second arms are configured to move between a grasp position in which the first and second arms grasp the received reconfigurable toy in the second configuration, and a release position in which the first and second arms release the received reconfigurable toy in the second configuration.

6. The toy set of claim 4, wherein the toy receiver is a scoop for receiving a reconfigurable toy in the second configuration.

7. The toy set of claim 5, wherein the first and second arms are configured to move from the grasp position to the release position prior to the propulsion mechanism propelling the reconfigurable toy along the propulsion axis.

8. The toy set of claim 1, wherein the toy receiver is configured to receive the reconfigurable toy in the first configuration, and wherein the propulsion mechanism is configured to propel the received reconfigurable toy in the second configuration.

9. The toy set of claim 8, wherein the toy receiver is a tray for receiving a reconfigurable toy in the first configuration.

10. The toy set of claim 8, further comprising toy engagement prongs, wherein the propulsion mechanism is further configured to transfer movement of the activator to the toy engagement prongs to transition the received reconfigurable toy from the first configuration to the second configuration prior to the propulsion mechanism propelling the reconfigurable toy along the propulsion axis.

11. The toy set of claim 1, wherein the activator is a rotatable lever.

12. The toy set of claim 1, wherein the activator is a crank.

13. The toy set of claim 1, wherein the propulsion mechanism includes a plurality of pivotably coupled links.

14. The toy set of claim 1, wherein the propulsion mechanism includes a trigger slidable within an elongated slot.

15. A toy set, comprising:

a plurality of reconfigurable toys, each reconfigurable toy of the plurality of reconfigurable toys is configured to transition between a first configuration and a second configuration, each reconfigurable toy comprising:

a main body;

a front portion rotatably connected to the main body, the front portion being movable between a first position and a second position;

a back portion rotatably connected to the main body, the back portion being movable between a third position and a fourth position; and a retaining mechanism for retaining the front portion in the second position and the back portion in the fourth position;

wherein, when the retaining mechanism retains the front portion and the back portion, the retaining mechanism prevents movement of the front portion from the second position to the first position and prevents movement of the back portion from the fourth position to the third position, and wherein, when the retaining mechanism does not retain the front portion and the back portion, movement of the front portion between the first position and the second position and movement of the back portion between the third position and the fourth position cause the toy to transition between the first configuration and the second configuration;

a launch mechanism, including:

a toy receiver configured to receive at least one reconfigurable toy of the plurality of reconfigurable toys, an activator configured to be moved by a user, and a propulsion mechanism configured to transfer movement of the activator to the toy receiver to propel the received reconfigurable toy along a propulsion axis; and a feed mechanism configured to store the plurality of reconfigurable toys and to feed those toys to the launch mechanism.

16. The toy set of claim 15, wherein the feed mechanism includes an angled track configured to support the plurality of reconfigurable toys in the second configuration and to provide a travel path for the plurality of reconfigurable toys to the toy receiver.

17. The toy set of claim 15, wherein the feed mechanism includes a canister configured to store the plurality of reconfigurable toys in the second configuration and to feed those toys to the toy receiver.

18. The toy set of claim 17, wherein the launch mechanism further includes a second mating piece adjacent to the toy receiver, wherein the canister includes an opening and a first mating piece complementary with the second mating piece, the first mating piece is configured to move between a first position in which the first mating piece covers the opening, and a second position in which the first mating piece exposes the opening to allow the plurality of reconfigurable toys to exit the canister, and wherein the first mating piece moves from the first position to the second position when the first mating piece engages the second mating piece.

* * * * *